US006035596A

United States Patent [19]

Brunnhofer

[11] Patent Number: 6,035,596

[45] Date of Patent: Mar. 14, 2000

[54] HEAT-INSULATING CONNECTING PROFILE WITH IR-BLOCKING FOIL

[75] Inventor: Erwin Brunnhofer, Fuldabrück, Germany

[73] Assignee: Technoform Caprano + Brunnhofer OHG, Fuldabruck, Germany

[21] Appl. No.: 09/102,460

[22] Filed: Jun. 22, 1998

[30] Foreign Application Priority Data

May 14, 1998 [EP] European Pat. Off. ..... 98108792

[51] Int. Cl.[7] ..... E04B 1/74

[52] U.S. Cl. ..... 52/404.1; 52/405; 52/222; 49/DIG. 1

[58] Field of Search ..... 49/DIG. 1; 52/222, 52/405, 404.1

[56] References Cited

U.S. PATENT DOCUMENTS 3,654,740 4/1972 Morton ..... 52/222
4,614,062 9/1986 Sperr ..... 49/504
4,725,324 2/1988 Schmidt ..... 156/242

FOREIGN PATENT DOCUMENTS 0 807 833 11/1997 European Pat. Off. .
94 11 396 10/1994 Germany .

*Primary Examiner*—Carl D. Friedman
*Assistant Examiner*—Patrick J. Chavez
*Attorney, Agent, or Firm*—Herbert Dubno; Andrew Wilford

[57] ABSTRACT

A heat-insulating connecting member has a warm metal profile, a cool metal profile extending parallel to and spaced from the warm profile, and a pair of parallel and spaced insulating strips bridging the profiles and defining an insulating compartment therebetween. One of the strips is formed with a web projecting generally across the compartment and having an outer edge adjacent the other strip. An infrared-reflecting foil is secured between the web and the warm profile under tension at a spacing from the warm profile between the outer end and the one strip.

17 Claims, 4 Drawing Sheets

HEAT-INSULATING CONNECTING PROFILE WITH IR-BLOCKING FOIL

FIELD OF THE INVENTION

The present invention relates to a heat-insulating connecting profile. More particularly this invention concerns such a profile used around a window, door, or facade panel and to an IR-blocking foil therefor.

BACKGROUND OF THE INVENTION

A standard heat-insulating connecting member normally comprises a warm metal profile, a cool metal profile extending parallel to and spaced from the warm profile, and a pair of parallel and spaced insulating strips bridging the profiles and defining an insulating compartment therebetween. Normally one of the strips is formed with a web provided with an layer that blocks or reflects infrared (IR) radiation. The so-called warm profile is the part of the member in cold climates and the outside part in hot climates and the IR-blocking or -reflecting layer serves to prevent radiant energy from passing through the connecting member from its hot side to its cold side.

In German utility model 94 11 396 the IR blocker is a metal-oxide layer that is simply painted onto the transverse web and is typically reflective. While this system works very well when new, with time it gets dirty and loses its ability to reflect, thereby reducing the R rating of the connecting member. Furthermore if the connecting member is anodized or hot lacquered, as is common when the profiles are aluminum, the IR-reflective layer is frequently destroyed. As a result such IR-blocking connecting members have not gotten past the theoretical stage into actual use.

European patent application 0,807,833 of Yamashita (Japanese priority of May 17, 1996) describes a reflective foil used in a projection television. Such a foil is extremely effective but is subject to the same degradation or destruction if mounted in a profile member that is subsequently heat-treated or anodized.

OBJECTS OF THE INVENTION

It is therefore an object of the present invention to provide an improved heat-insulating connecting member.

Another object is the provision of such an improved heat-insulating connecting member which overcomes the above-given disadvantages, that is which effectively blocks the transmission of IR radiation over the long term, and that can be applied to a painted or anodized system without increasing the size of the member.

A further object is to provide an improved IR-reflective foil for use in such a system.

SUMMARY OF THE INVENTION

A heat-insulating connecting member has a warm metal profile, a cool metal profile extending parallel to and spaced from the warm profile, and a pair of parallel and spaced insulating strips bridging the profiles and defining an insulating compartment therebetween. One of the strips is formed with a web projecting generally across the compartment and having an outer edge adjacent the other strip. According to the invention an infrared-reflecting foil is secured between the web and the warm profile under tension at a spacing from the warm profile between the outer end and the one strip.

The invention is based on the recognition that by not mounting the IR-reflective layer directly on the surface of the web, but instead forming it as a foil spaced from this web, the insulation effect is greatly increased. In fact it is possible to reduce the K-value by up to 40%.

According to the invention the web is positioned about one-third of a distance between the profiles from the warm profile. It is also possible for the other strip to be formed with a web lying between the web of the one strip and the cold profile. Furthermore the foil is spaced by an average distance of at least 1 mm from the web. This improves the insulation effect and allows any liquid, for instance introduced during manufacture or treatment of the connecting member, to drain from the system.

The foil is mounted in a pair of grooves by means of a pair of bead cords holding respective edges of the foil in the grooves. One of the grooves can be formed in the outer edge of the web. In manner the foil remains in place and is not like to become detached, as in the prior-art systems where delamination was a problem. In such a system it is also possible for both grooves to be formed in the one strip and the outer edge to be rounded so that the foil can be spanned over the outer edge.

An IR-reflecting foil for this application should have M a sufficiently high reflectivity for infrared radiation and also be stable with respect to the temperature and chemical environment the connecting member is used in. It should not change properties with time and should have minimal thermal conductivity both in and transverse to its plane. These properties are generally achieved according to the principle of multiple reflection described in U.S. Pat. No. 5,103,333 of Koai in a decor foil vacuum-coated with metal.

The foil according to this invention has in its plane a heat conductivity of from 0.2 W/mK to 0.4 W/mK. More particularly it is formed of a 20 nm to 50 nm thick metal or metal-oxide layer and a pair of 10 $\mu$m to 50 $\mu$m thick polymer films sandwiched to opposite faces of the layer. The metal or metal-oxide layer includes aluminum, copper, or tin. The polymer films according to the invention are of fluorinated ethylene propylene (FEP), polyethylene terephthalate (PET), polyethylene naphthalate, polypropylene (PP), polyethylene (PE), polymethylpenthene (PMP), or cycloolefin copolymer. The metal or metal-oxide layer is sputter or vacuum deposited on one of the films and the other film is secured to the one film by a layer of adhesive, preferably a 2 $\mu$m to 3 $\mu$m thick layer of polyurethane. A protective lacquer layer can be provided between the metal layer and the other film. This lacquer layer is of nitrocellulose and is 2 $\mu$m to 4 $\mu$m thick. Such a foil has a shrink capacity of at least 5%, preferably 10%, at 100° C.

BRIEF DESCRIPTION OF THE DRAWING

The above and other objects, features, and advantages will become more readily apparent from the following description, reference be made to the accompanying drawing in which.

SPECIFIC DESCRIPTION

Figure 1:
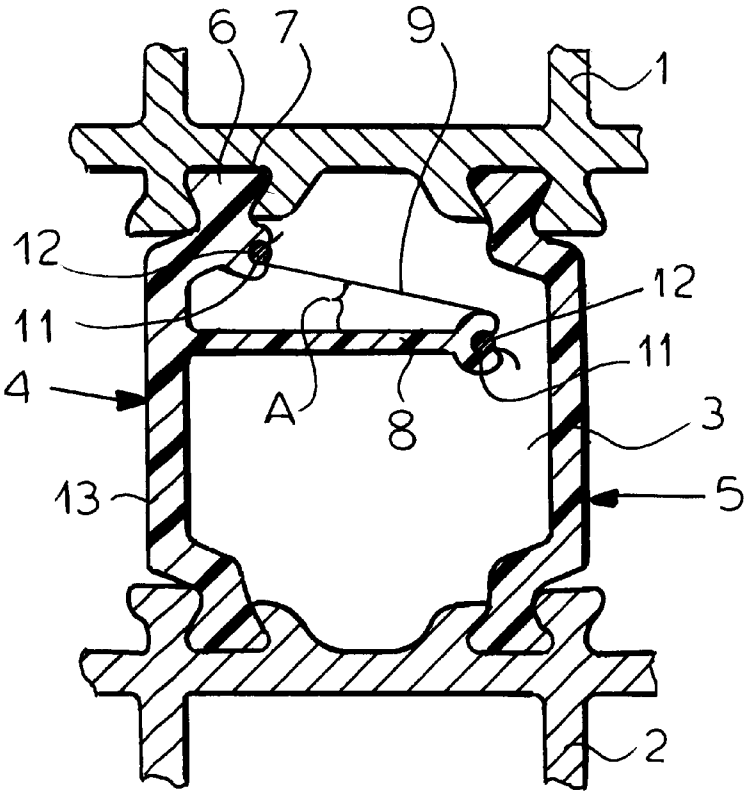

As seen in FIG. 1 an aluminum warm profile 1 and an aluminum cold profile 2 are held apart by a pair of plastic insulating strips 4 and 5 defining with the profiles 1 and 2 a longitudinally extending insulating compartment 3. As is standard the strips 4 and 5 have longitudinal dovetail edges 6 set in complementary grooves 7 the profiles 1 and 2.

The insulating strip 4 is formed unitarily with a flat longitudinally extending web 8 that extends across most of the compartment 3, subdividing it into a warm subcompartment adjacent the warm profile 1 and a larger cold subcompartment adjacent the profile 2, with the web 8 being much closer to the warm profile 1, in fact about one-third of the way from it to the profile 2.

In accordance with the invention an IR reflective foil 9 is spanned so as to lie in an angled plane, with its ends secured in grooves 11 by bead cords 12, one edge at a side wall 13 of the strip 4 and the opposite edge at an outer end of the web 8. This orients the foil 9 at an average spacing A of about 2 mm from the web 8 such that it will reflect back toward the warm profile 1 any IR radiation emanating from it.

Figure 2:
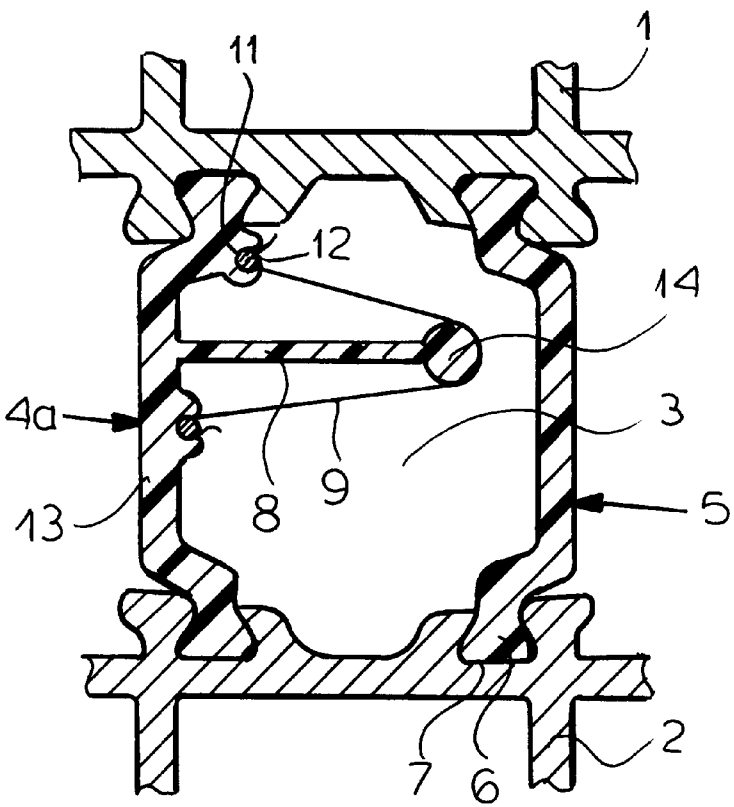
FIGS. 1 through 4 are cross sections through profile members according to the invention.

FIG. 2 shows an arrangement where the foil 9 has both edges seated in grooves 11 formed in the side 13 of the strip 4*a*, with its center spanned over a rounded outer edge 14 of the web 8. Thus the foil 9 has one section in the warm subcompartment and another in the cool subcompartment.

Figure 3:
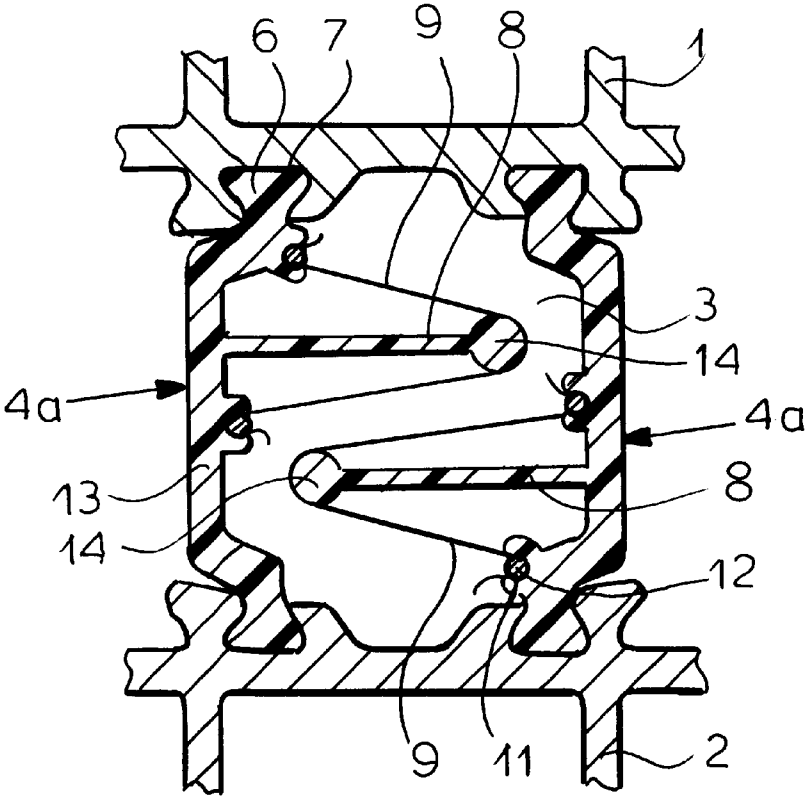

The system of FIG. 3 uses two identical strips 4*a* having webs 8 with rounded outer edges as in FIG. 2, but reversed so that two foils 9 are provided in the compartment 3.

Figure 4:
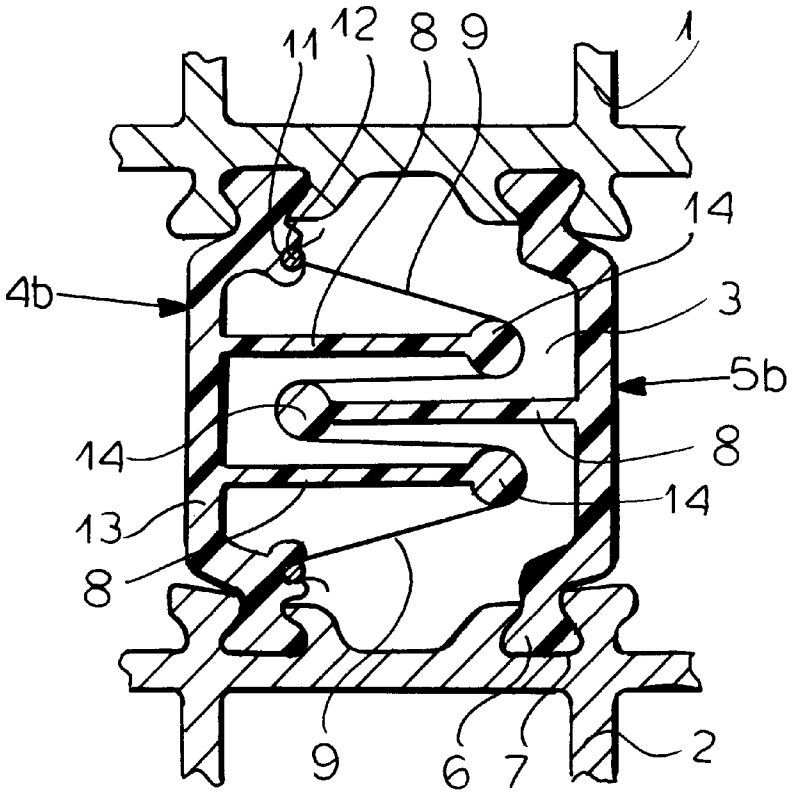

FIG. 4 shows another arrangement where the strip 4*b* has a pair of the webs 8, each one-third of the way from the end, and the strip 5*b* has a central such web 8, all with rounded outer ends 14. Thus a relatively long foil 9 is formed into a W-shape with its edges seated in grooves 11 in the strip 4*b*.

Figure 5:
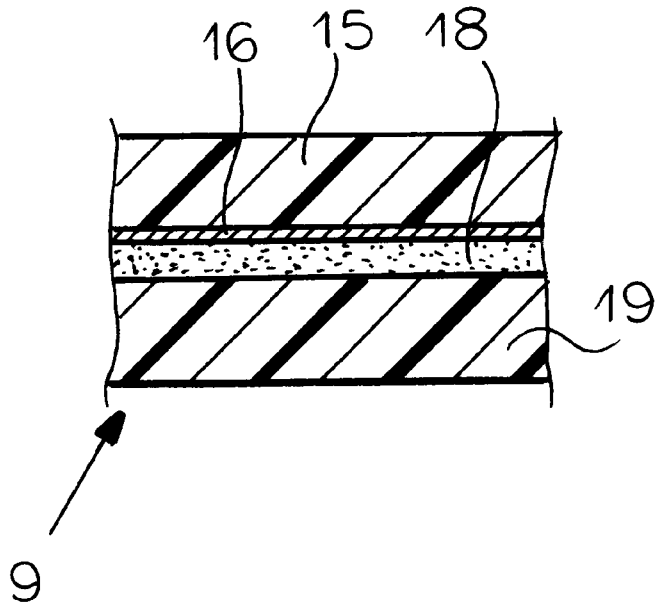
FIGS. 5 and 6 are large-scale sections through foils used in the members of this invention.

As shown in FIG. 5 the foil 9 is formed by outer polymer layer 15 and 19 some 10 μm to 50 μm thick of a fluoropolymer (e.g. FEP), polyester (e.g. PET or PEN), or polyolefin (e.g. P, PE, PMP, or a cycloolefin copolymer of Hoechst). Between these laminae 15 and 19 is a 20 nm to 50 nm thick layer 16 of metal (e.g. aluminum or copper) or metallic oxide (e.g. tin oxide). This layer 16 is sputter or vacuum deposited on the film 15 while the other polymer film 19 is laminated to it by means of a 2 μm to 3 μm thick glue layer 18 of a two-component polyurethane.

Figure 6:
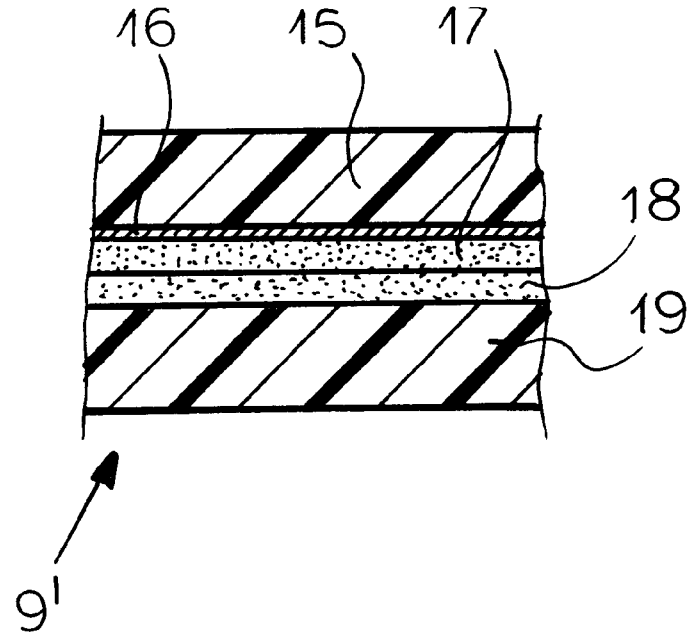

FIG. 6 shows a similar foil 9' where an additional protective lacquer layer 17 of nitrocellulose some 2 μm to 4 μm thick is provided between the reflective layer 16 and the glue layer 18. In both systems the foils 9 and 9' have a maiden shrink capacity of at least 5%, preferably 10%, at 100° C. so that in the finished product it is spanned tight in a plane, without wrinkles.

Figure 7:
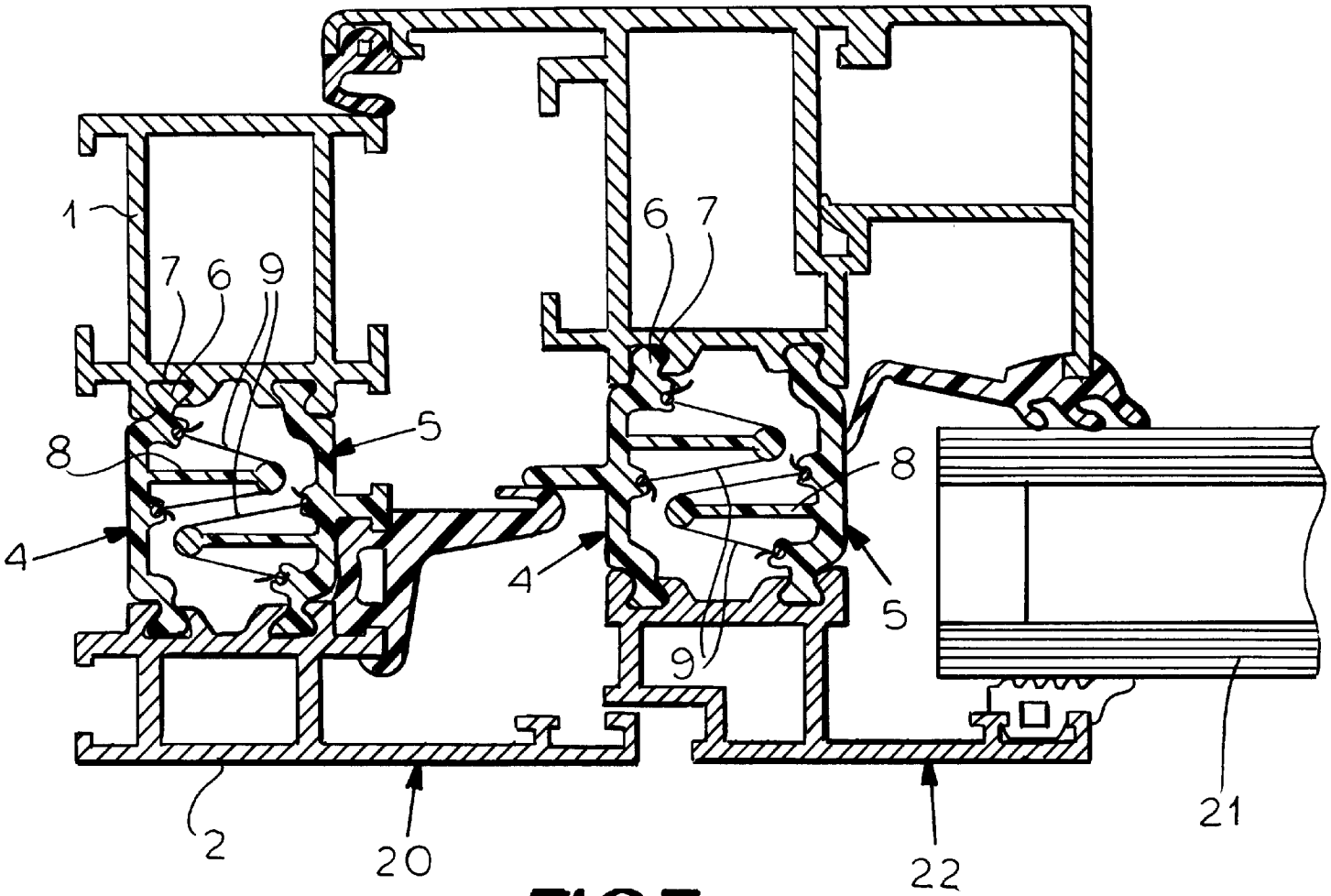
FIG. 7 is a cross section through a complex profile member in accordance with the invention.

FIG. 7 shows the application of the system of this invention to a window, with a stationary casing frame 20 and, movable relative thereto, a sash frame 22 carrying a window pane 21. Both frames 20 and 22 incorporate the thermal dam created by the connecting member of this invention.

I claim:

1. A heat-insulating connecting member comprising:

a warm metal profile;

a cool metal profile extending parallel to and spaced from the warm profile;

a pair of parallel and spaced insulating strips bridging the profiles and defining an insulating compartment therebetween, one of the strips being formed with a web projecting generally across the compartment and having an outer edge adjacent the other strip;

an infrared-reflecting foil between the web and the warm profile; and means securing the foil under tension at a spacing from the warm profile between the outer edge and the one strip.

2. The heat-insulating connecting member defined in claim 1 wherein the web is positioned about one-third of a distance between the profiles from the warm profile.

3. The heat-insulating connecting member defined in claim 1 wherein the other strip is also formed with a web lying between the web of the one strip and the cold profile.

4. The heat-insulating connecting member defined in claim 1 wherein the foil is spaced by an average distance of at least 1 mm from the warm profile.

5. The heat-insulating connecting member defined in claim 1 wherein the means includes a pair of grooves formed in at least one of the profiles and a pair of bead cords holding respective edges of the foil in the grooves.

6. The heat-insulating connecting member defined in claim 5 wherein one of the grooves is formed in the outer edge of the web.

7. The heat-insulating connecting member defined in claim 5 wherein both grooves are formed in the one strip and the outer edge is rounded, the foil being spanned over the outer edge.

8. The heat-insulating connecting member defined in claim 1 wherein the foil is an infrared-reflecting foil having in its plane a heat conductivity of from 0.2 W/mK to 0.4 W/mK.

9. The foil defined in claim 8 wherein the foil is formed of a 20 nm to 50 nm thick metal or metal-oxide layer and a pair of 10 μm to 50 μm thick polymer films sandwiched to opposite faces of the layer.

10. The foil defined in claim 9 wherein the layer includes aluminum, copper, or tin.

11. The foil defined in claim 9 wherein the polymer films are of fluorinated ethylene propylene, polyethylene terephthalate, polyethylene naphthalate, polypropylene, polyethylene, polymethylpenthene, or cycloolefin copolymer.

12. The foil defined in claim 9 wherein the metal layer is formed on one of the films and the other film is secured to the one film by a layer of adhesive.

13. The foil defined in claim 12 wherein the adhesive is a 2 μm to 3 μm thick layer of polyurethane.

14. The foil defined in claim 11, further comprising a protective lacquer layer between the metal layer and the other film.

15. The foil defined in claim 14 wherein the lacquer layer is of nitrocellulose and is 2 μm to 4 μm thick.

16. The foil defined in claim 8 wherein the foil has a shrink capacity of at least 5% at 100° C.

17. A heat-insulating connecting member comprising:

a warm metal profile;

a cool metal profile extending parallel to and spaced from the warm profile;

a pair of parallel and spaced insulating strips bridging the profiles and defining an insulating compartment therebetween, one of the strips being formed with a web projecting generally across the compartment and having an outer edge adjacent the other strip;

an infrared-reflecting foil between the web and the warm profile having in its plane a heat conductivity of from 0.2 W/mK to 0.4 W/mK; and means securing the foil under tension at a spacing from the warm profile between the outer edge and the one strip.

* * * * *